US005465518A

United States Patent [19]

Blaser

[11] Patent Number: 5,465,518

[45] Date of Patent: Nov. 14, 1995

[54] SHOOTING ARMS WITH A SAFETY DEVICE

[76] Inventor: Horst Blaser, Ziegelstadel 324, D-88316 Isny/Allg., Germany

[21] Appl. No.: 230,301

[22] Filed: Apr. 20, 1994

[30] Foreign Application Priority Data

Apr. 23, 1993 [DE] Germany ..... 43 13 261.8

[51] Int. Cl.[6] ..... F41A 17/76

[52] U.S. Cl. ..... 42/70.08

[58] Field of Search ..... 42/70.08, 70.01, 42/66; 89/148

[56] References Cited

U.S. PATENT DOCUMENTS

| | | | |
|---|---|---|---|
| 3,044,204 | 7/1962 | Zimmerman | 42/70.01 |
| 4,467,545 | 8/1984 | Shaw, Jr. | 42/70.01 |
| 4,682,435 | 7/1987 | Heltzel | 42/70.01 |
| 4,739,569 | 4/1988 | Battle | 42/70.01 |
| 4,829,692 | 5/1989 | Guild | 42/1.01 |
| 4,926,574 | 5/1990 | Rieger | 42/70.08 |
| 5,016,378 | 5/1991 | Sain | 42/70.06 |

*Primary Examiner*—Stephen M. Johnson
*Attorney, Agent, or Firm*—Meltzer, Lippe, Goldstein

[57] ABSTRACT

A sporting or hunting arm comprising a barrel assembly, a casing containing the triggering mechanism, a safety means for changing the arm from a safe to a ready-to-fire position, and a supplementary safety device comprising a time-lag relay started by a sensor when the safety lever is changed into the ready-to-fire position and emitting a signal after lapse of a preadjusted time interval, the signal being either an audible signal emitted by a buzzer or a visible signal emitted by a diode, and/or causing an actuator to return the safety means into the safe position. The safety means can be a cocking slide held in cocked position by a holding lever, wherein the actuator acts on the holding lever or on a shock-safety means. Warning means responding to the state of loading of the battery and an adjusting device accessible from outside can be provided.

12 Claims, 5 Drawing Sheets

SHOOTING ARMS WITH A SAFETY DEVICE

BACKGROUND OF THE INVENTION

The present invention relates to hunting or sporting arms and more particularly to a supplementary safety device for hunting or sporting arms with safety means that can be switched by means of a safety lever from a secure state to an activated state. The safety means can be either of the kind where in the secure state, the arm is cocked and the chain of action between the trigger and the cock or hammer is blocked at some point and where in the activated state this blocking is released, or of the kind where the arm is uncocked in the secure state and cocked in the activated state.

Handling of hunting or sporting arms always needs great care and circumspection. The trend to reduce trigger pull (from, say, 1,5 to 2 kg to as little as 200 to 300 grams) in order to increase accuracy of fire and reduce the cocking force has rendered such arms even more dangerous as only light shocks can lead to unintentional firing. The competent huntsman always handles the arm in the secure state and does not release the safety means or cock the arm until immediately before shooting. If, however, the arm is ready to fire and the huntsman's attention focussed on the game and he is distracted, he just might stop aiming, forget the state of the arm and handle the activated and ready-to-fire arm which can lead to inintentional firing. This danger cannot be averted by the most reliable of the known standard safety means because it only arises after their release. This "safety gap" can easily lead to grave consequences, and has often done so.

It is therefore the object of the invention to provide hunting or sporting arms with a supplementary safety device which reliably avoids such accidents by unintentional firing after the safety means of the arm has been released or the arm has been cocked.

It is a further object of the invention to provide hunting or sporting arms with a supplementary safety device against unintentional firing which involves a minimum of modifications of the arm concerned, and which is light in weight, small in bulk, and cheap to add to a known arm.

It is a still further object of the invention to provide arms with a safety lock blocking any of the elements of the effective chain trigger body - trigger sear - trigger arm - trigger link - hammer or cock with a supplementary safety device of the above mentioned character.

It is a still further object of the invention to provide arms with a separate exchangeable triggering mechanism as for example used in repeating arms with a supplementary safety device of the above mentioned character.

It is a still further object of the invention to provide arms with a cocking slide for activating the gun before shooting, usually hunting guns with a breach lock and one or more barrels, with a supplementary safety device of the above mentioned character.

Other objects, features and advantages of the invention will become apparent during a study of the detailed description.

SUMMARY OF THE INVENTION

The above objects are achieved, according to the invention by a safety device comprising a time-lag relay initiated by a sensor when the safety lever is switched into the ready-to-fire or "safety-off" position and emitting a signal after lapse of a preselected time interval. This supplementary safety device gives the marksman or huntsman only a limited time to take aim. If he does not fire within that predetermined time interval, for instance because the game moves out of sight, and forgets to return the safety lever into the "safety-on" position, the device emits a signal that for instance reminds him to do so. It is within the scope of the invention that the device emits more than one signal or signals of different kind. As the sensor can be fitted easily anywhere in any arm, the device is of universal use and can also be fitted later on.

In a preferred development of the invention, the signal emitted by the time-lag relay causes an actuator to return the safety lever into the "safety-on" position after a preselected time interval or if the huntsman ignores previous other signals. Thereby the dangerous "safety gap" referred to above is entirely closed. Thanks to the fact that the supplementary safety device cooperates with the safety means already provided and uses part of its structure, the technical expense is reduced considerably. In what way the the actuator returns the safety mechanism into the "safety-on" position depends on the kind of safety means employed, different embodiments are possible.

In a further development of the invention, the time-lag relay is an electronic device, the sensor a microswitch connected with the time-lag relay and the actuator is an electric solenoid connected with the time-lag relay, all three components being powered by an electric battery housed in the arm. Modern electronic devices are very small and therefore are easily accomodated in the arm, for instance in the butt. They also consume little energy and the battery need not be bulky. Even the solenoid consumes little energy because in a device according to the invention it is only energized for a very short time.

In one embodiment of the invention relating to a sporting or hunting arm wherein the safety means is a safety locking mechanism operated by the safety lever blocking any of the elements in the chain of action between trigger and cock or hammer, the actuator acts on the safety locking mechanism. As the safety lever is usually located on or adjacent to the butt of the arm for reasons of accessibility, the safety device can be easily accomodated in the butt and only short electrical leads are necessary between the actuator and the other electrical components.

In another embodiment of the invention relating to a sporting or hunting arm with a separate exchangeable triggering mechanism and wherein the safety means is a safety lock blocking the triggering mechanism, the actuator acts on the safety lock for the triggering mechanism. In this way the supplementary safety means is able to cooperate with any of the triggering mechanisms chosen. This embodiment makes the benefits of the invention accessible to many, though not all, types of repeating guns.

In a further embodiment of the invention relating to a sporting or hunting arm wherein the safety means is a cocking slide held in cocked position by a holding lever, the actuator acts on the holding lever. A cocking slide as a safety means is often chosen for hunting rifles. The holding lever is provided in such arms in order to hold the hammer in a cocked position and to enable the huntsman to decock it again by depressing the cocking slide, whereby also the holding lever is disengaged, and let the cocking slide return to the uncocked position by the force of the cocking spring. By the safety device acting on the holding lever already designed for easy decocking, the solenoid needs only a short stroke and little power. If such arms are also fitted with an inertia pendulum acting on the decocking lever, the actuator can also cooperate to advantage with the inertia pendulum.

In another development, the signal can be either an audible signal emitted by a buzzer or a visible signal emitted by a diode visible from the lower side of the gun where it can be seen by the huntsman when resting and holding the gun upright in front of him. This development is suitable for any arm and also for retrograde fitting.

Further auxiliary devices, for instance a warning means responding to the battery being flat or an adjusting device accessible from outside for adjusting the time lag can be added to advantage.

DETAILED DESCRIPTION OF THE INVENTION

Figure 1:
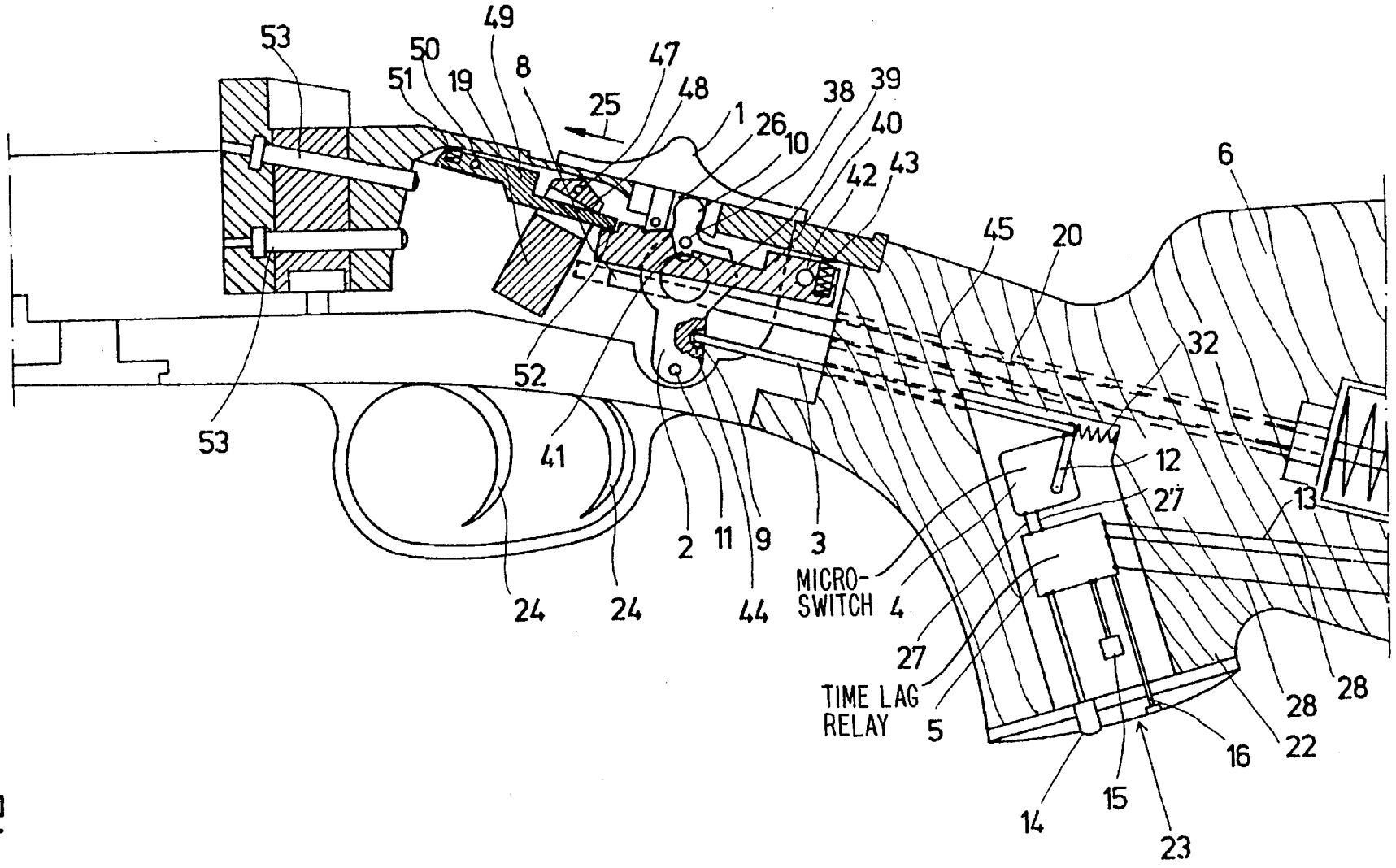
FIG. 1 is a longitudinal section through the central part of a first embodiment of an arm with the supplementary safety device according to the invention.
Figure 2:
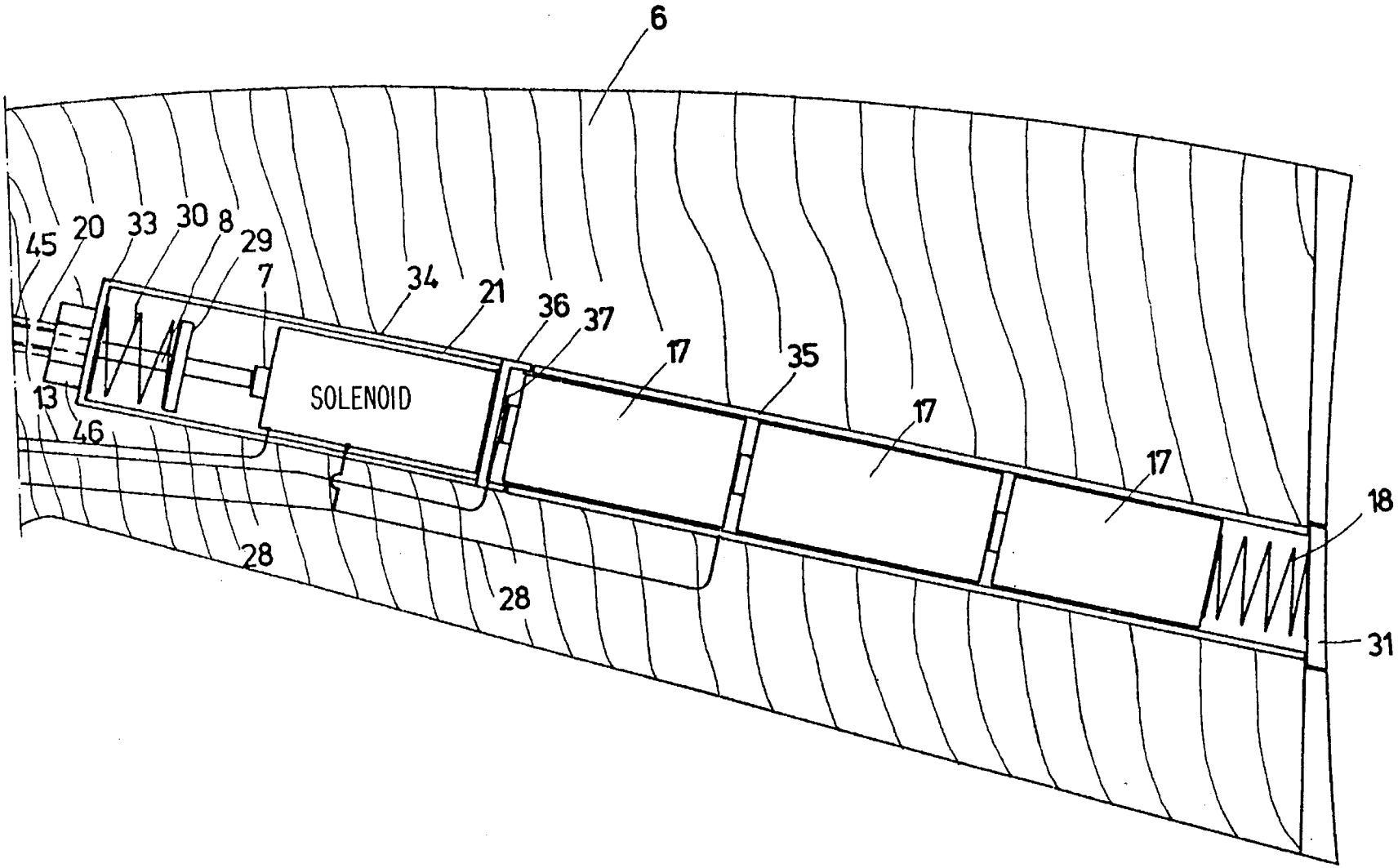
FIG. 2 is a longitudinal section through the rear part of the arm of FIG. 1.

Referring first to FIG. 1 and FIG. 2, the arm shown partly comprises a butt 6 with an integral handhold 22 underneath and a stock casing containing a cocking mechanism described in more detail in the published German Patent application 41 38 894 which is herein included by way of reference. The parts in this stock casing not essential to the invention (hammer, hammer spring, trigger mechanism and the parts for selecting which barrel will be fired) are therefore not here described again. Only the firing pins 53 and the trigger 24 are shown.

The cocking mechanism is cocked by shifting a cocking slide 1 disposed on top of the stock casing in a forwardly direction, indicated by the arrow 25. The cocking slide 1 is provided with a recess 26 engaged by a lug 10 of a cocking arm 2. The cocking arm 2 is pivotally mounted on a pivot 11 and bears a transverse holding bolt 38 adjacent the foot of the lug 10 which coope-rates with a ramp 39 of a holding lever 40. When the cocking slide 1 is pushed forward in order to tension the hammer spring (not shown) as indicated by the arrow 25, the cocking arm 2 is pivoted forward in a counterclockwise direction and the holding bolt 38 rides on the ramp 39 until it engages a notch 41. In order to be able to engage the holding bolt 38, the holding lever 40 is journalled on a peg 42 and biased by a spring 43 in clockwise direction.

In order to make the arm uncock itself automatically when the arm sustains a shock, a shock-security device comprising an inertia-pendulum 19 and an uncocking lever 49 is provided. The inertia-pendulum 19 is pivotally mounted on a pin 47 and has a control edge 48 cooperating with the uncocking lever 49. The uncocking lever 49 is rotatably supported by a pin 50 and biased against the control edge 48 by a spring 51. When the arm sustains a longitudinal shock, the swinging pendulum 19 forces the rear end of the uncocking lever 49 in a downward direction, as shown in FIG. 1. The rear end of the uncocking lever 49 rests on a recess 52 in the front end of the holding lever 40. The swinging pendulum 19 acting on the uncocking lever 49 therewith also urges the holding lever 40 in a downward direction and the holding bolt 38 leaves the notch 41. The cocking arm 2 is now urged back into the uncocked position by the cocking spring (not shown). These safety means are well known.

The supplementary safety device according to the invention will now be described: The cocking arm 2 is provided with a depression 9 receiving an extremity 44 of a feeler rod 3 which is held in the depression 9 by means of a compression spring 32. The feeler rod 3 links the cocking arm 2 with the lever 12 of a microswitch 4.

When the cocking slide 1 is shifted forward in the direction of the arrow 25 in order to cock the arm, the feeler rod 3 actuates the microswitch 4, therewith indicating that the arm is ready to fire and starting a time-lag relay 5, for instance by closing an electric circuit of which the leads 27 form part.

When the arm has been cocked during a preselected interval, the time-lag relay 5 started by the microswitch 4 emits a signal which can also trigger certain functions. The time lag relay 5 emits for instance a signal via a light emitting diode 14 after a preselected interval and then an audible signal by means of a buzzer 15 after a further preselected interval. As a last resort it emits a signal activating a solenoid 7.

The safety device need not operate in these three phases. It can be designed or adjusted so as to perform only one function, e.g. emit only an audible or a visible signal, or only two functions or actuate the solenoid 7 without a previous warning signal. The diode is disposed at the lower end 23 of the handhold 22 and is thus visible for the marksman when held in a standing position.

The time lag relay 5 preferably is an electronic component. It could also be a mechanical device, and is energized from batteries 17 by means of leads 28. Leads 13 are provided between the time lag relay 5 and the solenoid 7. An adjusting device 16 is provided for preselecting the time intervals, for example a rotary potentiometer for adjusting the impedance influencing the time-lag relay in a known manner and to adjust time lags of, say, between 30 and 180 seconds. Different time lags can be preselected for the different functions, one or two for the visible and audible signals, and one for the signal actuating the solenoid 7.

The movement of the solenoid 7 is transmitted to the shock security device 19,49 by an actuating rod 8. The actuating rod 8 is sheathed by a tube 20 which can be contained within the clamp bolt 45 which join the butt 6 to the stock casing by means of a nut 46. When the interval preselected for the time lag relay 5 has lapsed, the solenoid 7 is energized so as to push the actuating rod 8 forward until it hits the pendulum 19. This causes the uncocking lever 49 to tilt in a clockwise direction, the holding lever to tilt in a counterclockwise direction and the cocking arm 2 to be urged back into the uncocked position by the cocking spring (not shown), as described above. FIG. 1 shows the actuating rod 8 in two positions. The position drawn in full line is the normal position assumed when the solenoid 7 is not energized and does not push the rod 8. The interrupted line indicates the active position, in which the rod swings the pendulum and so decocks the arm. The solenoid 7 is chosen so as to provide a sufficient stroke and enough power to overcome the spring 30 in order to decock the arm reliably.

FIG. 2 shows the rear part of the butt 6. In order to hold the actuating rod 8 in a well defined position and to keep it away from the pendulum 19 when not actuated, a disk 29 biased by a spring 30 is provided, the latter resting against the bottom 33 of a housing case 21 sunk into a bore 34 in the butt 6. The butt 6 contains a series of electric batteries 17 housed in a jacket 35. This jacket 35 shares the bore 34 with the housing case 21 containing the solenoid 7 which is insulated from the batteries 17 by means of an insulator disk 36. The batteries 17 are connected to the leads 28 by a flag 37. In order to join the batteries between them, a compression spring 18 is provided at the rear end of the housing case 21 covered by a lid 31, as known from torch lights. Instead of the stack of batteries 17, a small single higher voltage battery can be specified. In order to safeguard operation of the safety device at all times, a battery charge control light can be provided indicating when the batteries are flat. Also an on-off switch can be provided in order to spare the batteries when the arm is not in use.

Figure 3:
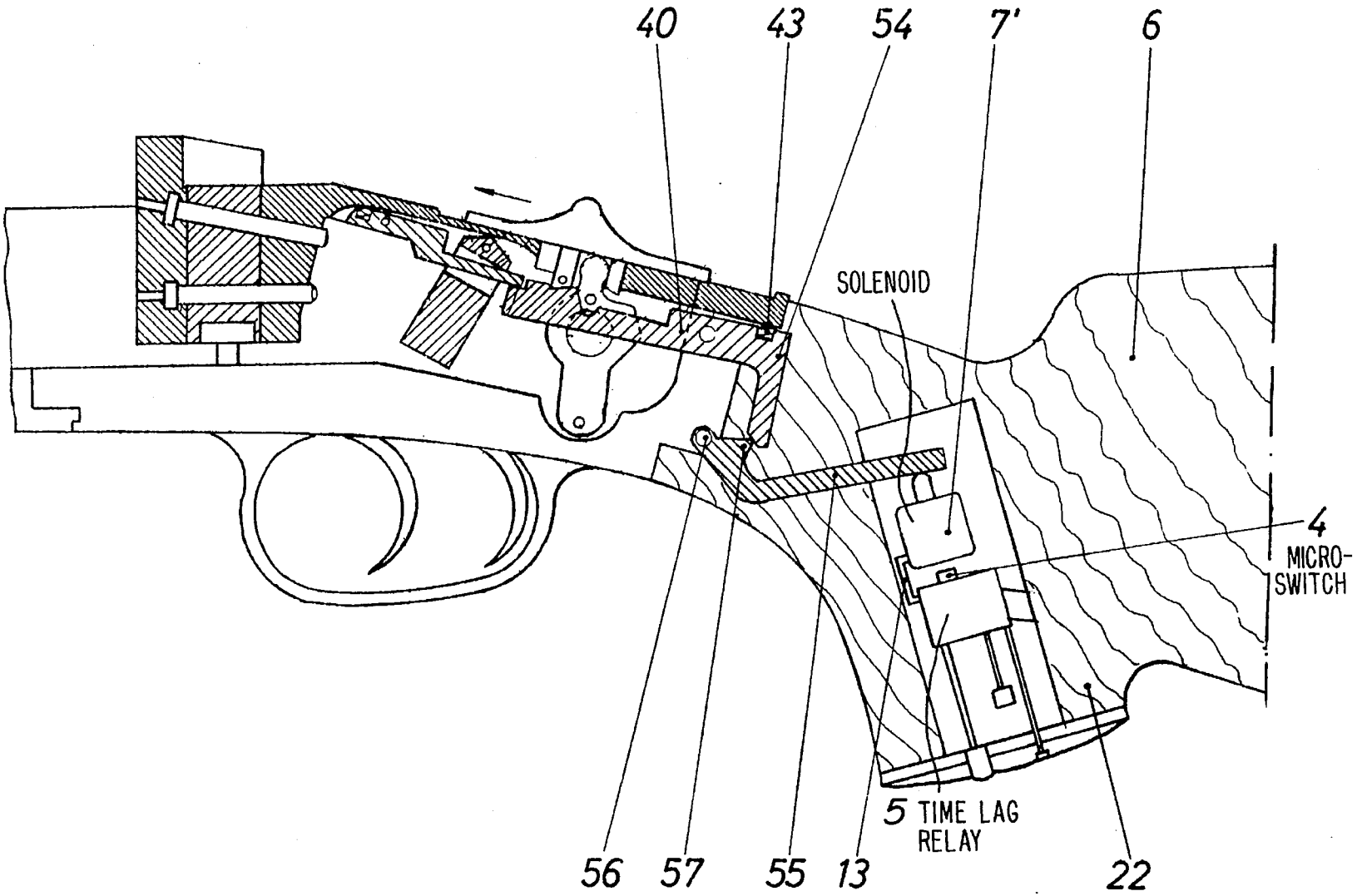
FIG. 3 is a longitudinal section similar to FIG. 1 of a variation of the first embodiment.

FIG. 3 shows a modification of the embodiment of FIG. 1, differing only from the latter in that the very holding lever 40 bears a downward bent tail 54 which cooperates with a cam 57 of a tiltable actuating lever 55. This lever 55 in turn is actuated by the solenoid 7, which, thanks to this particularly favourable arrangement can be so small as to be housed in the handhold 22 of the arm. By this, the leads 13 need not be long and the micro switch can be fixed adjacent the time lag relay 5, obviating leads entirely. The batteries can be fitted into the butt 6, as previously described, but could also be housed in the handhold 22 as they can be very small.

Figure 4:
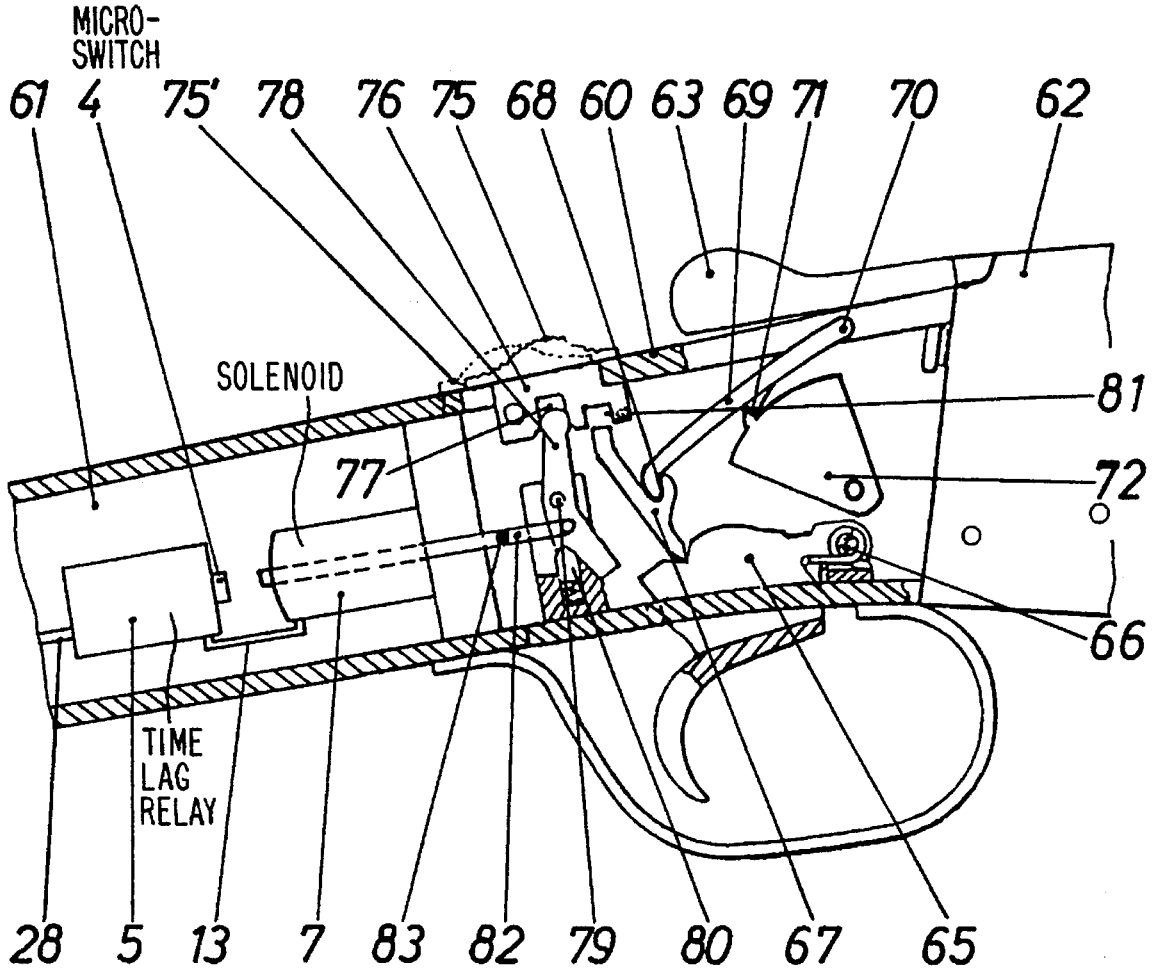
FIG. 4 is is a longitudinal section through the central part of a second embodiment of an arm with the supplementary safety device according to the invention.

FIG. 4 shows a second embodiment, wherein the stock casing 60 of a breach lock rifle is disposed between a butt 61 and a barrel unit 62, the breach being locked by a breach lock lever 63. The trigger body 65 is tiltably journalled on a pin 66 and cooperates with a trigger arm 69 by intermediary of a trigger link 67. The trigger arm 69 is journalled around an axis 70 in the lock box 60 and its loose end engages a trough 68 of the trigger link 67. The trigger arm 69 has a sear 71 holding the hammer or cock 72 in a cocked position. The effective chain runs thus from the trigger body 65 to the hammer or cock 72 by way of the trigger link 67, the trigger arm 69, the trigger sear 71 and is shown only by way of example. Various effective chains are possible.

A safety slide 75 is shiftable outside the stock casing 60, its root 76 sticking inside the casing 60 has a guideway 77 and a recess 81. The guideway 77 is engaged by a safety lever 78 tiltable about a pin 79 and held in one or the other position by a spring loaded ratchet 80. The recess 81 receives the upper end of the trigger link 67 when the trigger is operated and the safety slide is in the "safety-off" position shown in full lines. In the "safety-on" position 75' of the safety slide indi-cated by a dotted line, the recess 81 is offset with regard to the upper end of the trigger link 67 and therefore unaccessible. Therefore the chain of action referred to above is blocked because the trigger link 67 is blocked and the trigger 65 cannot be pulled.

To this is added according to the invention the time-lag relay 5, the microswitch 4 and the solenoid 7. The latter is disposed in the butt 61 and is connected with the safety lever 78 by the pushrod 82 which goes through the solenoid and by the joint 83. When the safety slide 75 is shifted into the unlocked position, the pushrod 82 is moved in a rearward direction and operates the microswitch 4, whereupon the time-lag relay 5 is started. When the preselected interval has lapsed, the relay switches on the solenoid 7 supplied by the batteries (not shown) via conduits 28 and 13 and the safety slide 75 is brought into the "safety-on" position.

Figure 5:
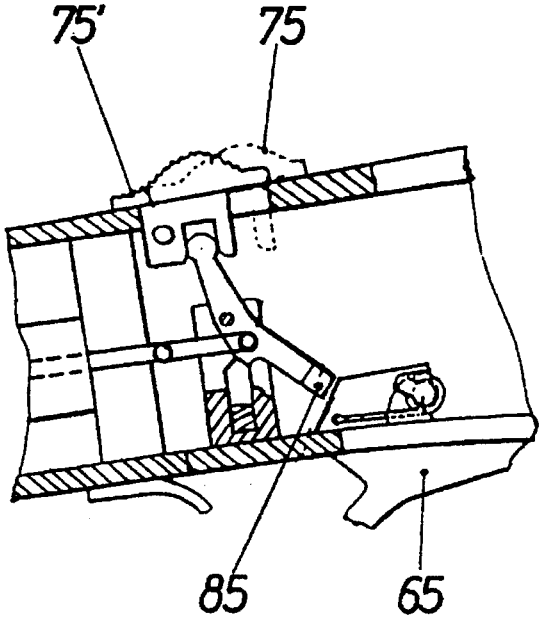
FIG. 5 is a longitudinal section similar to FIG. 4 of a variation of the second embodiment.

FIG. 5 shows a modification of the embodiment of FIG. 4, differing from the latter in that the safety slide blocks a different part in the chain of action of the trigger assembly. When the safety slide is in locked position 75' shown in through line, the arm 85 of the safety lever 78 blocks the trigger body 65. When the safety slide is in unlocked position 75 shown in dotted line, the trigger can be operated. This is an example of the safety slide 75 blocking an other element of the chain of action. Further ways of blocking the chain of action by acting on other links are within the scope of the present invention.

Figure 6:
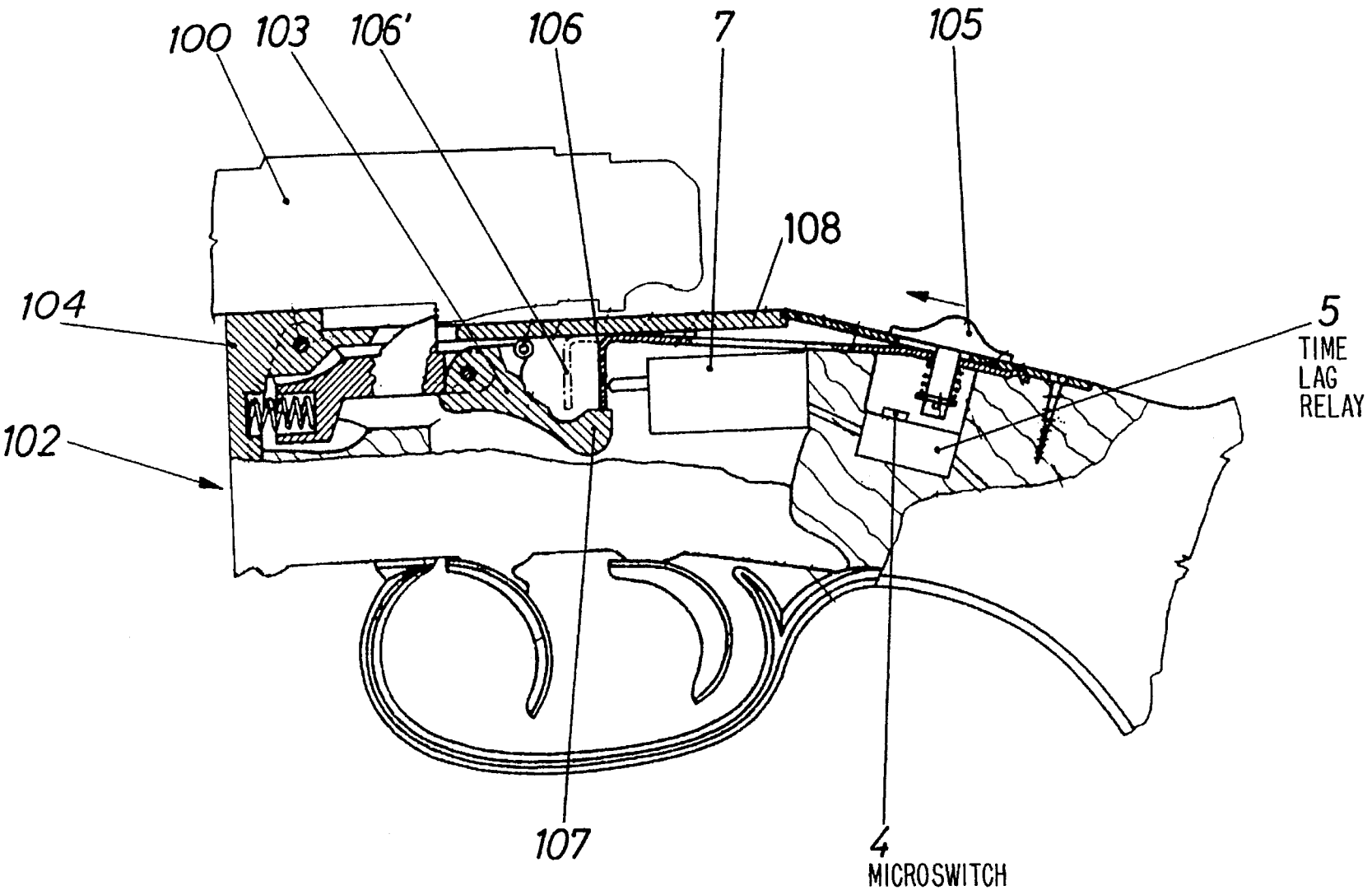
FIG. 6 is a longitudinal section through the central part of a third embodiment of an arm with the safety device according to the invention.

FIG. 6 shows a third embodiment of the invention, relating to an arm with a lock 100 of any other type, for instance a cylinder lock of a repeating arm which allows firing successive rounds without reloading. The butt 101 holds under the lock 100 an exchangeable trigger assembly 102. This trigger assembly 102 is a separate unit commercially available in various designs and therefore is not shown in detail. It would in any case comprise a trigger sear 104 operated by an intermediate lever 103. A safety slide 105 is arranged behind the trigger assembly 102 on the upper side of the butt 101 and connected to a crutch 106. When the safety slide is in the locked position, the crutch 106 is interposed between a head 107 of the intermediate lever 103 and the housing 108 of the trigger assembly 102 and so blocks the trigger sear 104. In the unlocked position, the crutch 106', shown in broken lines, does not block the trigger sear sear 104 anymore. The crutch 106 again is linked with the solenoid 7 and the microswitch 4 here is so arranged as to respond when the safety slide 105 is shifted into the unlocked position.

From the foregoing is will be understood that a wide variety of arms can be supplemented with the novel safety device giving rise to a wide variety of embodiments only some of which have been described by way of example and many others are fully comprehended by the spirit of the invention.

I claim:

1. A gun comprising a barrel assembly, a casing containing a triggering mechanism, a safety device operatively connected to the triggering mechanism for changing the gun between a safe and a ready-to-fire position, a supplementary safety device comprising a sensor which detects when said gun has been changed to the ready-to-fire position, a time-lag relay which is started by the sensor when the gun is changed into the ready-to-fire position and which emits a signal after lapse of a preselected time interval, and an actuator which includes a mechanical linkage interacting with said safety device to cause said safety device to return the gun into the safe position after receiving the signal.

2. The gun of claim 1, wherein the sensor is a microswitch which detects when said safety device changes the gun from the safe to the ready-to-fire position, the time-lag relay is an electronic device connected to said microswitch, and said actuator is connected to the time-lag relay and includes a solenoid said mechanical linkage which interacts with said safety device.

3. The gun of claim 2 wherein said time-lag relay, said microswitch, and said solenoid are powered by an electric battery housed in said gun.

4. The gun of claim 3 further comprising a warning means which emits a signal when the power in said electric battery runs low.

5. The gun of claim 1 further comprising a cocking mechanism within said casing, and wherein said safety device comprises a decocking mechanism.

6. The gun of claim 5 wherein said safety device comprises a cocking slide held in a cocked position by a holding lever, and wherein said mechanical linkage of said actuator acts on said holding lever to release said cocking slide from said cocked position.

7. The gun of claim 6 wherein said safety device further comprises shock-safety means cooperating with said holding lever for releasing said cocking slide from said cocked position when said gun undergoes a shock, and wherein said mechanical linkage of said actuator acts on said safety shock means.

8. The gun of claim 1 wherein said supplementary safety device is connected to a buzzer which emits an audible signal when said preselected time interval has lapsed.

9. The gun of claim 1 further comprising a diode located on a lower side of said gun and connected to said supplementary safety device, said diode emitting a visual signal when said preselected time interval has lapsed.

10. The gun of claim 1 further comprising an adjusting device on a butt of said gun for adjusting the preselected time interval.

11. The gun of claim 1 wherein said trigger mechanism includes a chain of action between a trigger and a firing pin, and wherein said safety device comprises a safety locking mechanism blocking an element in said chain of action, said actuator acting on said safety locking mechanism.

12. The gun of claim 1 wherein said triggering mechanism comprises an exchangeable unit, and wherein said safety device comprises a safety lock blocking said triggering mechanism, said actuator acting on the safety lock of said triggering mechanism.

* * * * *